US008403689B2

(12) United States Patent
Li et al.

(10) Patent No.: US 8,403,689 B2
(45) Date of Patent: Mar. 26, 2013

(54) CARD EDGE CONNECTOR

(75) Inventors: Zhuang-Xing Li, Kunshan (CN); Xue-Hai Shen, Kunshan (CN); Xiao-Zhi Fu, Kunshan (CN); Wen-Jun Tang, Kunshan (CN); Xue-Wu Bu, Kunshan (CN)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 0 days.

(21) Appl. No.: 13/297,191

(22) Filed: Nov. 15, 2011

(65) Prior Publication Data

US 2012/0164859 A1 Jun. 28, 2012

(30) Foreign Application Priority Data

Dec. 25, 2010 (CN) ..... 2010 2 0679951

(51) Int. Cl.
*H01R 13/62* (2006.01)

(52) U.S. Cl. ..... 439/160

(58) Field of Classification Search ..... 439/157, 439/160, 152, 153, 155, 159, 372, 341
See application file for complete search history.

(56) References Cited

U.S. PATENT DOCUMENTS

| | | | | |
|---|---|---|---|---|
| 5,494,451 | A * | 2/1996 | Bowers | 439/328 |
| 5,668,348 | A * | 9/1997 | Lin | 174/16.3 |
| 5,690,499 | A * | 11/1997 | Howell et al. | 439/157 |
| 5,943,218 | A * | 8/1999 | Liu | 361/801 |
| 7,371,097 | B1 * | 5/2008 | Pennypacker et al. | 439/327 |
| 7,371,103 | B2 | 5/2008 | McGrath et al. | |

* cited by examiner

*Primary Examiner* — Neil Abrams
*Assistant Examiner* — Phuongchi Nguyen
(74) *Attorney, Agent, or Firm* — Wei Te Chung; Ming Chieh Chang

(57) ABSTRACT

A card edge connector includes an elongated housing extending along a lengthwise direction thereof and having a pair of opposed side walls, and a central slot between the side walls. A plurality of contacts are retained in the housing and exposed to the central slot. A pair of ejector mechanisms are rotatable retained on two opposite ends of the housing. A pair of auxiliary insulators are attached to the ejector mechanisms, respectively. A tie wrap is located on the auxiliary insulators to urge the auxiliary insulators to prevent the ejector mechanisms from rotating.

18 Claims, 5 Drawing Sheets

CARD EDGE CONNECTOR

BACKGROUND OF THE INVENTION

1. Field of the Invention

The present invention relates to card edge connectors, more particularly to a card edge connector attached with an accessory to retain a pair of ejector mechanisms thereof.

2. Description of Related Art

Card edge connectors are employed widely in computers to receive memory cards, graphic cards, network interfaces et al. The card edge connector as described in U.S. Pat. No. 7,371,103B2 includes an elongated housing, a plurality of contacts retained in the housing for electrically connecting a corresponding memory card, a pair of ejector mechanisms attached at two opposited ends of the housing for locking the memory card, and a pair of auxiliary insulators retained on the ejector mechanisms respectively. The housing has a pair of side walls, a central slot between the side walls for receiving the memory card, and a pair of tower portions at two ends thereof. Each tower portion each has a receiving cavity receiving the ejector mechanism therein, and a pair of locking slots disposed at two lateral sides of the receiving cavity. The ejector mechanism has a main body, an ejecting portion inwardly extending from a lower end of the body portion to be under the central slot for pushing the memory card out from the central slot, a locking head inwardly extending from the main body along a lengthwise direction of the housing to lock with the memory card, and an operating portion opposite to the locking head in the lengthwise direction.

While the memory card is inserted into the central slot, the ejector mechanism rotates inwardly to lock with the memory card for preventing the memory card from moving in an upper-to-lower direction. The body portion of the ejector mechanism has a pair of locking protrusions disposed on two lateral sides thereof to respectively lock with the locking slots for limiting the ejector mechanism from rotating autonomously. The tower portion has a retaining slot recessed on a top thereof. The auxiliary insulator has a hook portion locking with the retaining slot for further preventing the ejector mechanism from being opened autonomously while the card edge connector is shocked in transportation. However, the retaining slot and the hook portion are easily abraded in multiple using applications and cause the ejector mechanism to be opened easily.

Hence, an improved card edge connector is desired to overcome the above problems.

BRIEF SUMMARY OF THE INVENTION

According to one aspect of the present invention, a card edge connector comprises: A card edge connector, comprising: an elongated housing extending along a lengthwise direction thereof and having a pair of opposed side walls, and a central slot between the side walls for receiving a memory card; a plurality of contacts retained in the housing and exposed to the central slot; a pair of ejector mechanisms rotatably retained on two opposite ends of the housing, and having a body portion, an operating portion and a locking head oppositely extending from a top end of the body portion in the lengthwise direction, respectively, and an ejecting portion inwardly extending from the body portion; a pair of auxiliary insulators attached to the ejector mechanisms, respectively; and a tie wrap linking the pair of auxiliary insulators together and limiting the auxiliary insulators to move outwardly away from each other so as to prevent the ejector mechanisms from rotating.

According to another aspect of the present invention, a card edge connector for receiving a memory card, comprises: A card edge connector, comprising: an elongated housing having a pair of side walls, a central slot between the side walls for receiving a memory card, and a pair of tower portions upwardly from two opposite ends of the central slot in a lengthwise direction of the housing; a plurality of contacts retained in the housing and exposed to the central slot; a pair of ejector mechanisms retained in the tower portions, respectively, and being movable between an open position and a closed position, the ejector mechanisms each having a body portion, an operating portion and a locking head oppositely extending from a top end of the body portion in the lengthwise direction; and a pair of auxiliary insulators respectively assembled to the operating portions and isolated away from the tower portions; a tie wrap tying the auxiliary insulators together to prevent movement of ejector mechanisms from the closed position to the open position.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
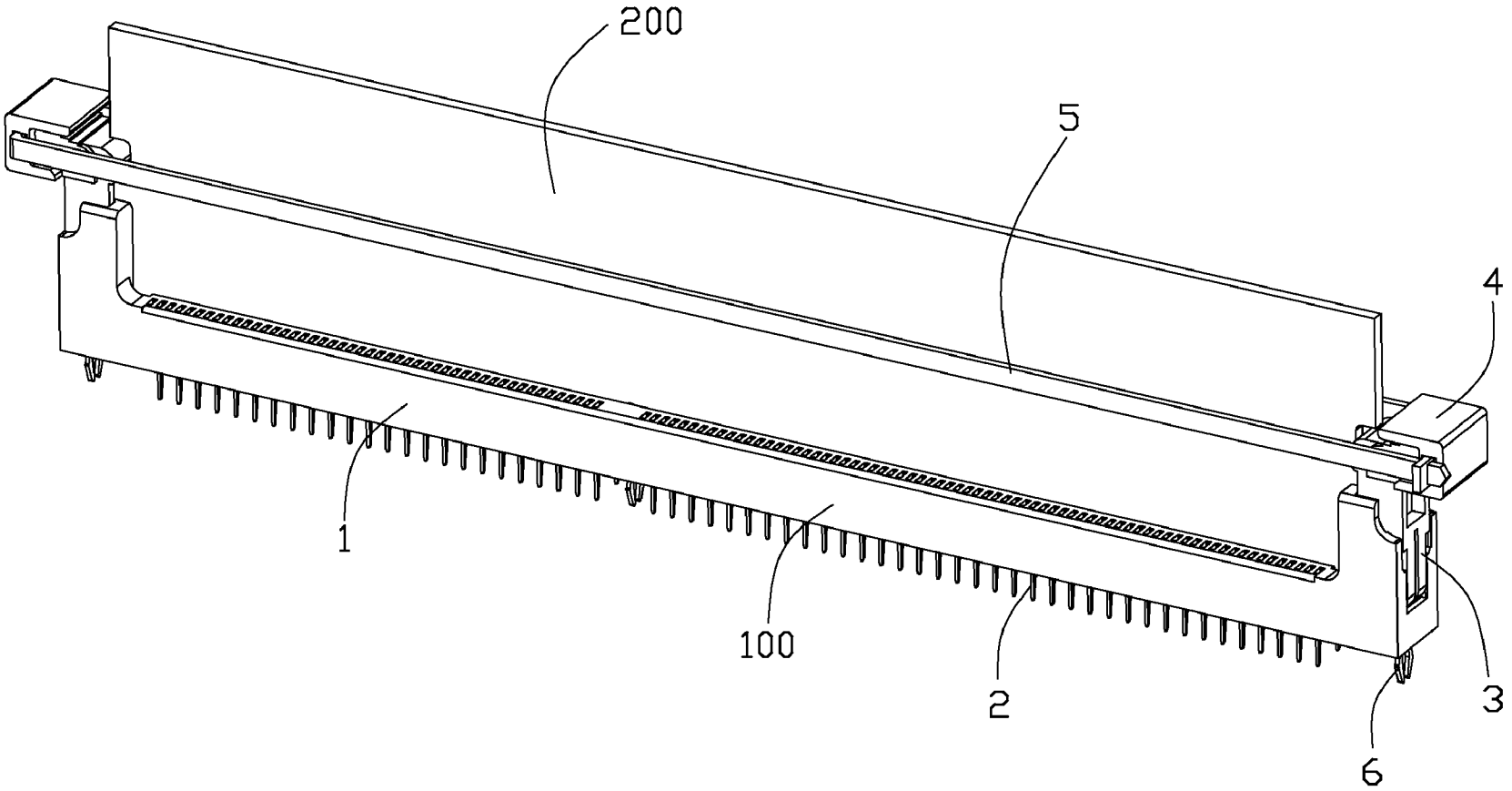
FIG. 1 is a perspective view of a card edge connector according to the present invention with a memory card inserted thereinto.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Referring to FIGS. 1-5, a card edge connector 100 for mating with a memory card 200 according to the present invention is disclosed. The card edge connector 100 includes an elongated housing 1, a plurality of contacts 2 retained in the housing 1, a pair of ejector mechanisms 3 pivoted on two opposited ends of the housing 1, a pair of auxiliary insulators 4 respectively attached to the ejector mechanisms 3, a tie wrap 5 secured on the auxiliary insulators 4, and a number of metal board locks 6 retained at a bottom of the housing 1 for mounting the card edge connector 10 onto a mother board (not shown). The auxiliary insulators 4 and the tie wrap 5 are together regard as an accessory.

Figure 2:
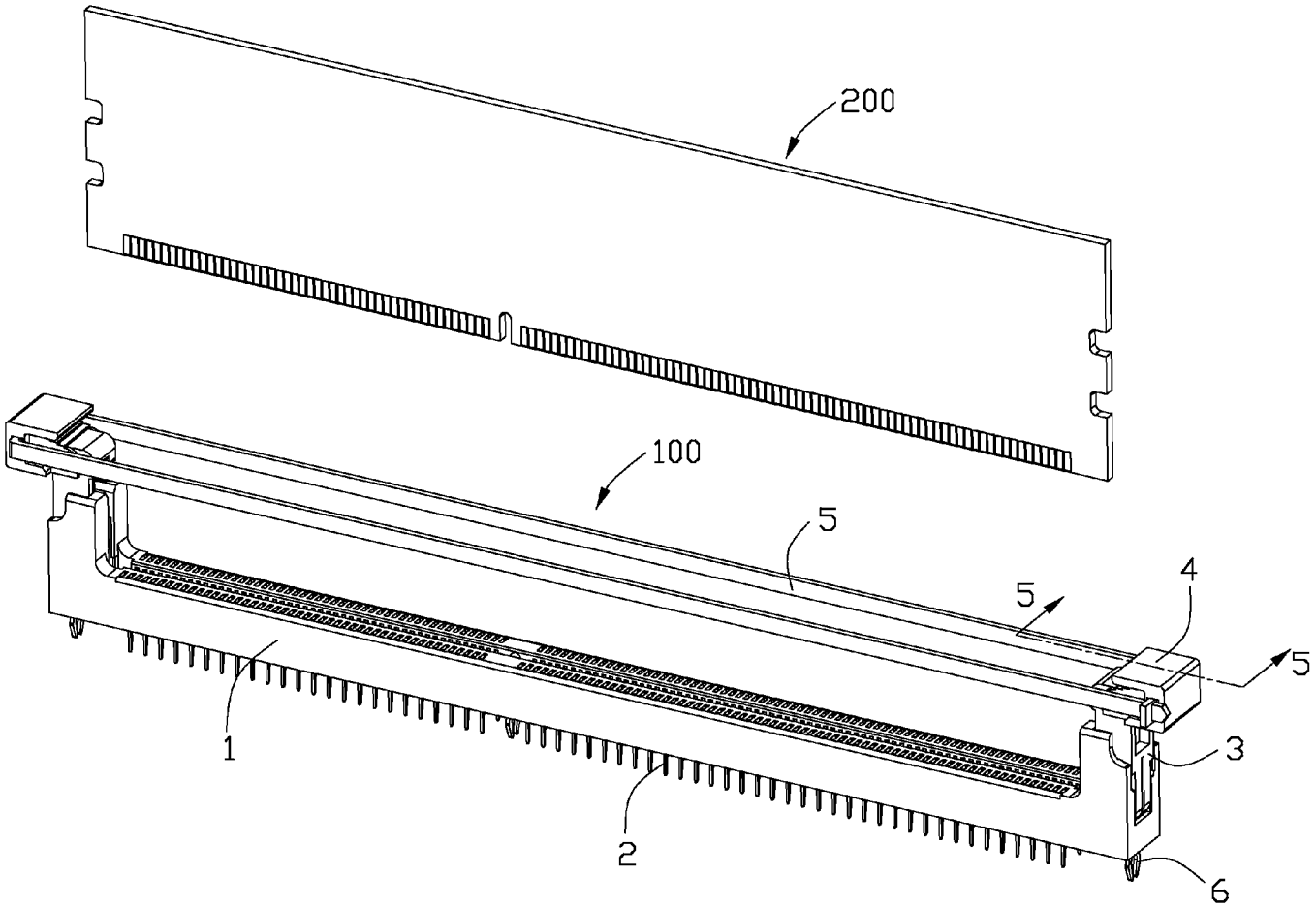
FIG. 2 is another perspective view of the card edge connector shown in FIG. 1 with the memory card withdrawn therefrom.
Figure 3:
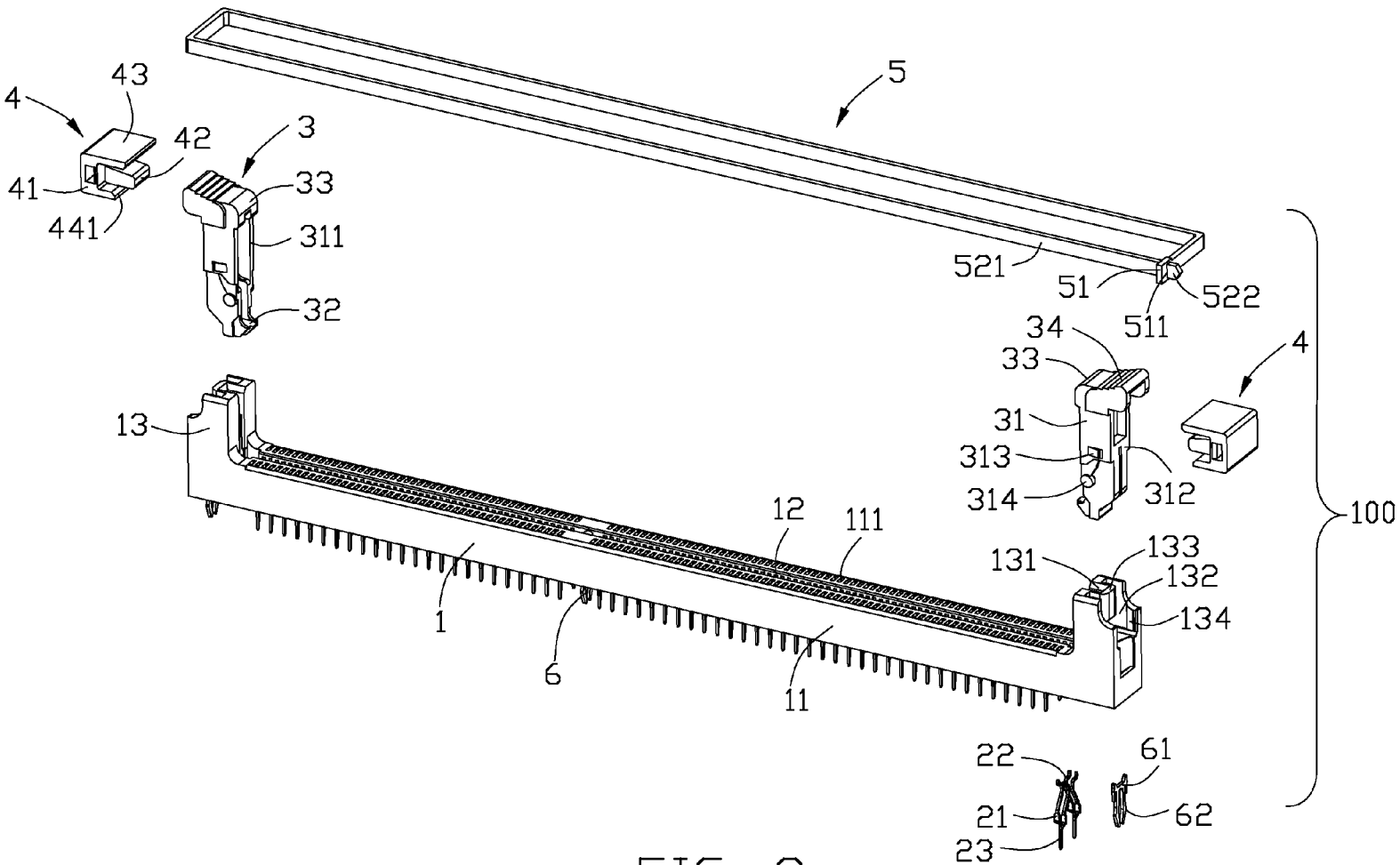
FIG. 3 is partly exploded view of the card edge connector shown in FIG. 1.
Figure 4:
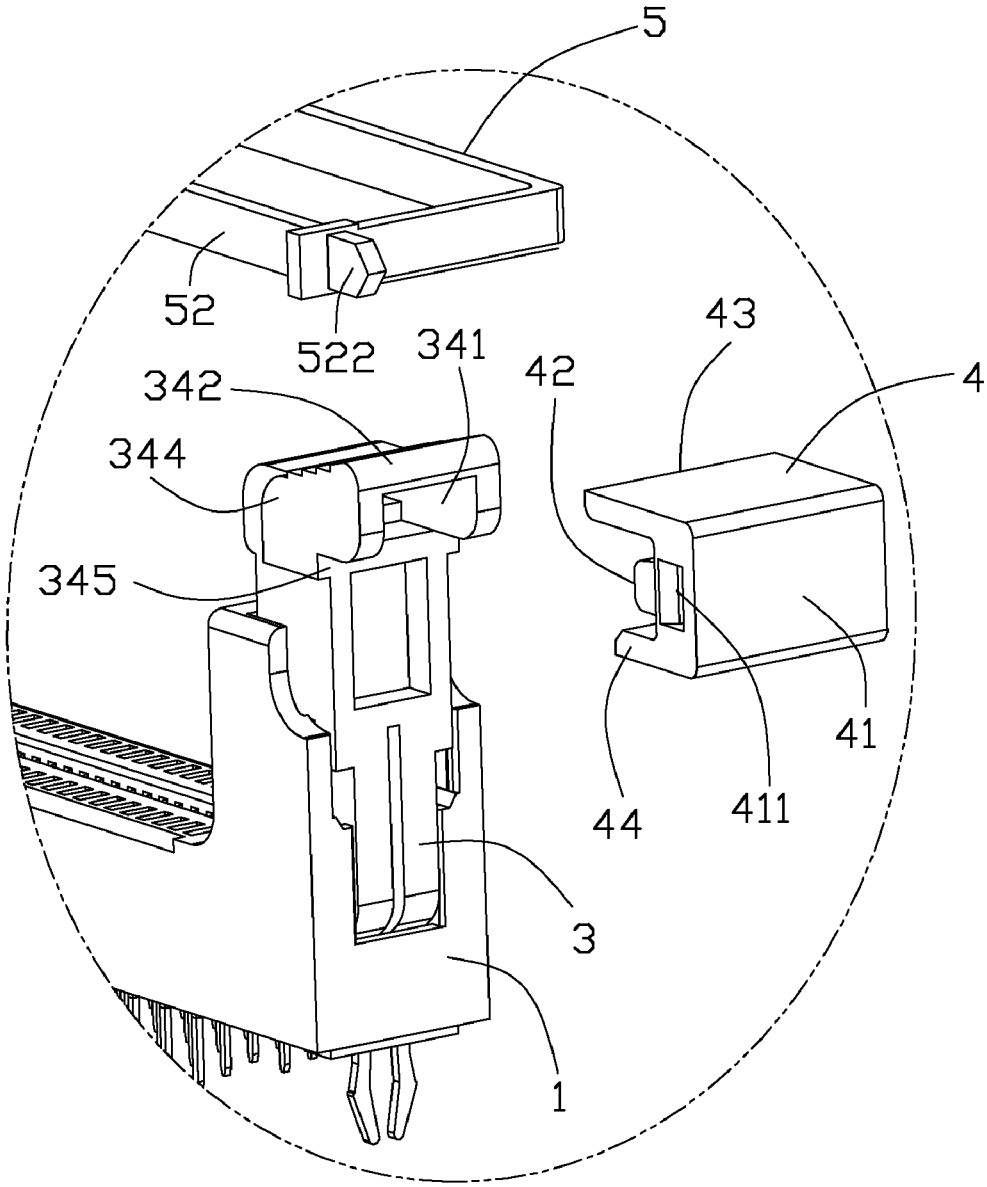
FIG. 4 is a partly enlarged exploded view of a part of the card edge connector shown in FIG. 1.
Figure 5:
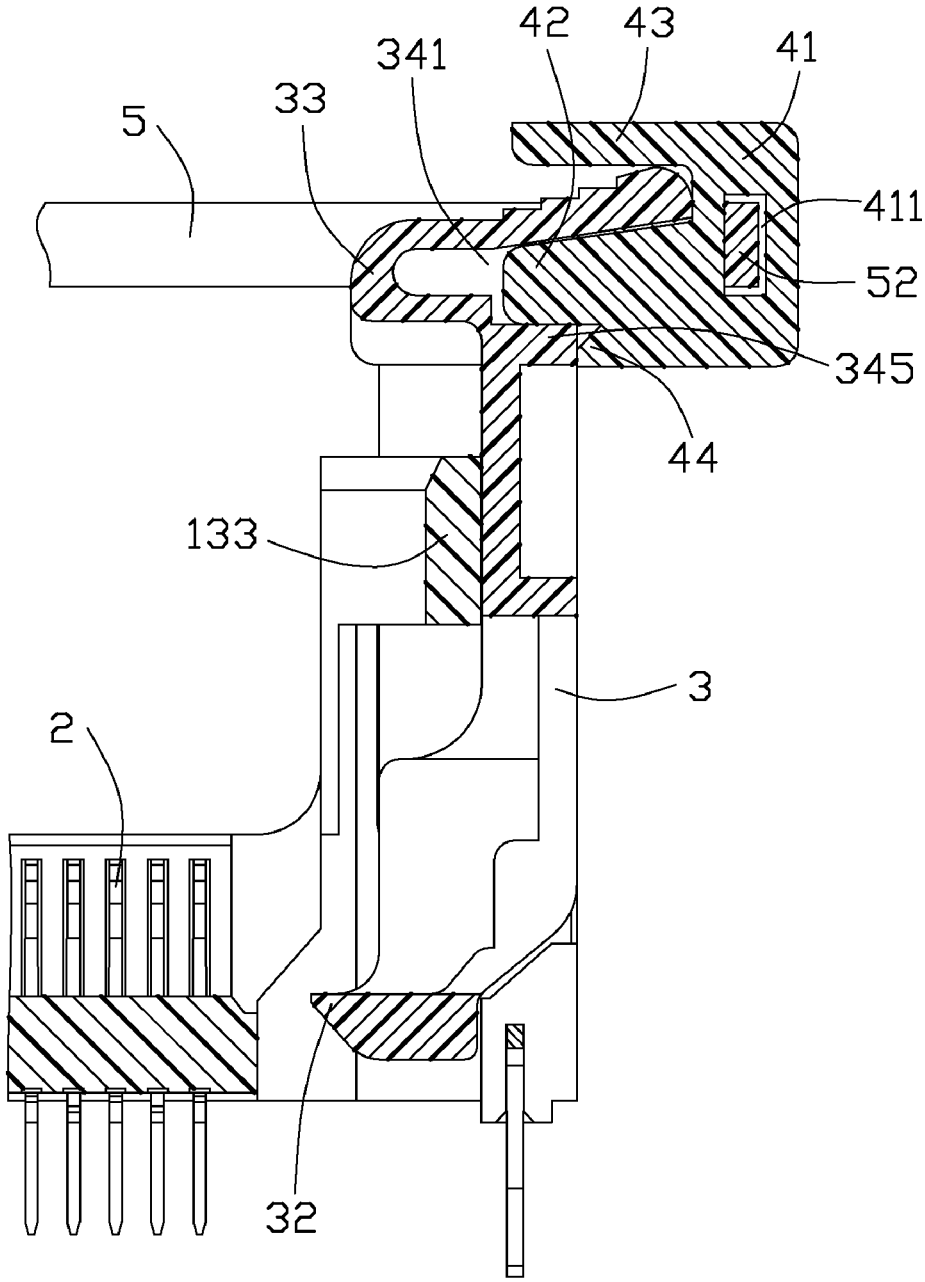
FIG. 5 is a cross-sectional view taken along line 5-5 of the card edge connector shown in FIG. 2.

Referring to FIGS. 1-3, the housing 1 extends along a lengthwise direction and has a pair of side walls 11, a central slot 12 recessed between the side walls 11, and a pair of tower portions 13 located on two ends of central slot 12. The side walls 11 each has a row of passageways 111 communicating with the centrals slot 12. The contacts 2 are divided into two rows and each has a locating portion 21 retained in the corresponding passageway 111, an elastic contact portion 22 extending into the central slot 12 from the locating portion 21, and a soldering tail 23 extending beyond the housing 1 from the locating portion 22 and adapted for being mounted onto the mother board.

Referring to FIG. 3, each of the pair of tower portions 13 has a first receiving cavity 131 adjacent to the central slot 12 for receiving a side edge of the memory card 200, a second receiving cavity 132, and a reinforcement wall 133 disposed between the first and the second receiving cavity 131, 132 in the lengthwise direction for limiting a movement of the memory card 200 in the lengthwise direction. The second receiving cavity 132 is opened to exterior in the lengthwise direction so that the ejector mechanism 3 rotates conveniently, and has a pair of stop blocks 134 located two opposited inner side walls of the second receiving cavity 132, and a pair of pivot holes (not shown) under the stop blocks 134, respectively.

Each of the ejector mechanisms 3 is rotatably retained in the second receiving cavity 132, and has a body portion 31, an ejecting portion 32 inwardly extending to the receiving slot 12 from a lower end of the body portion 31, a locking head 33 and an operating portion 34 oppositely extending from a top end of the body portion 31 in the lengthwise direction. The body portion 31 has an inner wall 311 for abutting against the reinforcement wall 133, an outer wall 312 opposited to the inner wall 311 in the lengthwise direction, a pair of locking protrusions 313 located at two outer lateral sides thereof for respectively engaging with the stop blocks 134, and a pair of spindles 314 located under the locking protrusions 313 and received into the pivot holes of the housing 1.

The operating portion 34 includes a pressing portion 342 for being pressed by operator, a pair of lateral walls 344 extending downwardly from two opposited ends of the pressing portion 342, and a retaining slot 341 between the lateral walls 344. The pressing portion 342 and the pair of lateral walls 344 each outwardly protrudes beyond the abuting portion 345 in the lengthwise direction. The retaining slot 341 opens outwardly toward exterior in the lengthwise direction. The operating portion 34 further has an abutting portion 345 located under the lateral walls 344 and having an outside surface coplanar with the outer wall 312.

The auxiliary insulators or covers 4 each includes a base portion 41, an upper wall 43, a lower wall 44 and a retaining wall 42 which inwardly extend from the base portion 41 in the lengthwise direction. The retaining wall 42 is disposed between the upper wall 43 and the lower wall 44 in an upper-to-lower direction of the card edge connector 100. The upper wall 43 and the retaining wall 42 both inwardly protrude beyond the lower wall 44 in the lengthwise direction. The upper wall 43 and the lower wall 44 are wider than the retaining wall 42 in a transverse direction perpendicular to the lengthwise direction and the upper-to-lower direction. The upper wall 43 and the lower wall 44 protrude beyond the retaining wall 42 in the transverse direction to form a space among the upper wall 43, the lower wall 44 and the retaining wall 42, the lateral walls 344 of the ejector mechanism 3 are received in the space. The base portion 41 defines a through hole 411 therethrough in the transverse direction.

Referring to FIGS. 2 and 3, the tie wrap 5 includes a head 51, and an elongated strap portion 52 extending from the head 51. The elongated strap portion 52 includes a strap body 521 connecting to the head 51 and a distal end 522 extending from the strap body 521. The distal end 522 defines a plurality of teeth (not shown) disposed at outer sides thereof. The head 51 defines a securing hole 511, and at least one tabs (not shown) disposed in the securing hole 511 and configured to mesh with the teeth of the distal end 522. The elongated strap portion 52 has a rectangular configuration with the distal end 522 passing across the head 51.

The board locks 6 each includes a retaining portion 61 retained in the bottom of the housing 1, and a pair of hook tails 62 downwardly extending from the retaining portion 61 for latching with a corresponding through hole defined in the mother board.

Referring to FIGS. 1-5, when the card edge connector 100 is assembled with the memory card 200, firstly, the memory card 200 is downwardly inserted into the central slot 12, a bottom end of the card edge connector 200 presses onto the ejecting portion 32 of ejector mechanism 3 to push the ejector mechanism 3 to rotate inwardly, the locking protrusions 313 lock with stop blocks 134 for preventing the ejector mechanism 3 from rotating outwardly, the locking head 33 locks into a cutout of the memory card 200. Secondly, secure the auxiliary insulators 4 to the ejectors mechanism 3 respectively, the retaining wall 42 is retained in the retaining slot 341 to preventing the auxiliary insulators 4 from moving along both the lengthwise direction and the transverse direction, the upper wall 43 downwardly abuts the pressing portion 342, the pressing portion 342 is sandwiched between the upper wall 43 and the retaining wall 42 and outwardly abuts the base portion 41 in the lengthwise direction. The lower wall 44 inwardly presses onto the abuting portion 345 in the lengthwise direction for preventing the auxiliary insulator 4 from rotating; the auxiliary insulators 4 are disposed above the tower portion 13. Finally, the elongated strap portion 52 of the tie wrap 5 passes through the through holes 411 of the pair of auxiliary insulators 4 in turn, the distal end 522 is inserted into the securing hole 5111 of the head 51 with the teeth engaging with the tab to be prevented from escaping away from the head 51, thus, the auxiliary insulators 4 and the tie wrap 5 are assembled together in the lengthwise direction as the ejectors mechanism 3 can not rotate outwardly, the memory card 200 could be retained in the central slot 12 reliably.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A card edge connector, comprising:

an elongated housing extending along a lengthwise direction thereof and having a pair of opposed side walls, and a central slot between the side walls for receiving a memory card;

a plurality of contacts retained in the housing and exposed to the central slot;

a pair of ejector mechanisms rotatably retained on two opposite ends of the housing, and having a body portion, an operating portion and a locking head oppositely extending from a top end of the body portion in the lengthwise direction, respectively, and an ejecting portion inwardly extending from the body portion;

a pair of auxiliary insulators attached to the ejector mechanisms, respectively; and a tie wrap linking the pair of auxiliary insulators together and limiting the auxiliary insulators to move outwardly away from each other so as to prevent the ejector mechanisms from rotating.

2. The card edge connector as claimed in claim 1, wherein the operating portion defines a retaining slot opening outwardly toward exterior in the lengthwise direction, the auxiliary insulator has a retaining wall retained in the retaining slot.

3. The card edge connector as claimed in claim 2, wherein the auxiliary insulators each includes a base portion defining a through hole in a transverse direction perpendicular to the lengthwise direction for passing through by the tie wrap, the retaining wall protrudes inwardly from a middle portion of the base portion in the lengthwise direction.

4. The card edge connector as claimed in claim 3, wherein the tie wrap includes a head, and an elongated strap portion extending from the head, the elongated strap portion includes a strap body connecting to the head, and a distal end extending from the strap body and defining a plurality of teeth disposed at outer sides thereof, the head defines a securing hole for the distal end passing through, and at least one tabs disposed in the securing hole and meshing with the teeth of the distal end to prevent the distal end from escaping away from the head.

5. The card edge connector as claimed in claim 3, wherein the operating portion includes a pressing portion, a pair of lateral walls extending downwardly from the pressing portion, and an abutting portion disposed under the lateral walls, the pressing portion, the lateral walls and the abutting portion surround around the retaining wall to prevent the auxiliary insulator from moving both in an upper-to-lower direction and the transverse direction.

6. The card edge connector as claimed in claim 5, wherein the auxiliary insulator has an upper wall inwardly protruding from the base portion and disposed above the retaining wall, the upper wall downwardly presses onto the pressing portion of the ejector mechanism.

7. The card edge connector as claimed in claim 6, wherein the auxiliary insulator has a lower wall under the retaining wall and inwardly abuting against the abuting portion of the ejector mechanism in the lengthwise direction for preventing the auxiliary insulator from rotating.

8. The card edge connector as claimed in claim 7, wherein the housing includes a pair of tower portions disposed at two opposite ends of the central slot and respectively receiving the ejector mechanisms therein, the auxiliary insulators and the tie wrap are disposed above the tower portions, the upper wall and the lower wall protrude beyond the retaining wall in the transverse direction to form a space among the upper wall, the lower wall and the retaining wall, the lateral walls of the ejector mechanism are received in the space.

9. A card edge connector, comprising:

an elongated housing having a pair of side walls, a central slot between the side walls for receiving a memory card, and a pair of tower portions upwardly from two opposite ends of the central slot in a lengthwise direction of the housing;

a plurality of contacts retained in the housing and exposed to the central slot;

a pair of ejector mechanisms retained in the tower portions, respectively, and being movable between an open position and a closed position, the ejector mechanisms each having a body portion, an operating portion and a locking head oppositely extending from a top end of the body portion in the lengthwise direction; and a pair of auxiliary insulators respectively assembled to the operating portions and isolated away from the tower portions;

a tie wrap tying the auxiliary insulators together to prevent movement of ejector mechanisms from the closed position to the open position.

10. The card edge connector as claimed in claim 9, wherein the auxiliary insulators are assembled to the operating portions only along the lengthwise direction, the auxiliary insulators each includes a base portion, an upper wall and a lower wall protruding inwardly from the base portion, the operating portion is retained between the upper wall and the lower wall.

11. The card edge connector as claimed in claim 10, wherein the base portion defines a through hole in the transverse direction, the tie wrap includes a head, and an elongated strap portion extending from the head and including a strap body connecting to the head and passing through the through hole of the base portion, and a distal end extending from the strap body, the head defines a securing hole locking with the distal end.

12. The card edge connector as claimed in claim 10, wherein the operating portion includes a pressing portion, a pair of lateral walls extending downwardly from the pressing portion, an abuting portion disposed under the pressing portion, and a retaining slot formed thereamong, the auxiliary insulator has a retaining wall protruding from the base portion to disposed between the upper wall and the lower wall and retained in the retaining slot, the lower wall abuts against an outside surface of the abutting portion in the lengthwise direction.

13. The card edge connector as claimed in claim 12, wherein the upper wall and the lower wall protrude beyond the retaining wall in a transverse direction perpendicular to the lengthwise direction to form a space among the upper wall, the lower wall and the retaining wall, the lateral walls of the ejector mechanism are received in the space.

14. A card edge connector for retaining a daughter card therein, comprising:

an elongated insulative housing defining a center slot extending along a lengthwise direction for receiving said daughter card therein;

a plurality of terminals disposed in the housing by two sides of the center slot;

a pair of ejectors located at two opposite ends of the housing in said lengthwise direction, each of said ejectors pivotally mounted to the housing about an rotation axis extending in a transverse direction perpendicular to said lengthwise direction and equipped with an upper locking lug for locking the daughter card in the housing and a lower kicker for ejecting the daughter card out of the housing; and a tie wrap extending along the lengthwise direction and dimensioned similar to the center slot along said lengthwise direction, said tie wrap defining in said lengthwise direction two opposite end regions each grasping around a top portion of the corresponding ejector; wherein said tie wrap is essentially located at a same level with the top portion of the ejector and configured for being spaced from the daughter card in the transverse direction in a top view when the daughter card is locked in the housing by said pair of ejectors;

a pair of auxiliary covers respectively located upon the top portions of the corresponding ejectors, wherein the two end regions of the tie wrap are engaged thereto.

15. The card edge connector as claimed in claim 14, wherein said tie wrap is plastic.

16. The card edge connector as claimed in claim 14, wherein each of the covers defines a through groove through which said tie wrap extends.

17. The card edge connector as claimed in claim 14, wherein the tie wrap defines a pair of elongated strips located by two sides of the center slot in a top view.

18. The card edge connector as claimed in claim 17, wherein the tie wrap is of a loop.

* * * * *